United States Patent [19]

Markin

[11] 4,412,395

[45] Nov. 1, 1983

[54] DISPLAY DEVICE

[76] Inventor: William R. Markin, 5502 Chippewa Rd., Toledo, Ohio 43613

[21] Appl. No.: 211,836

[22] Filed: Dec. 1, 1980

Related U.S. Application Data

[63] Continuation of Ser. No. 938,017, Aug. 30, 1978, abandoned.

[51] Int. Cl.[3] ..... G09F 19/00

[52] U.S. Cl. ..... 40/530

[58] Field of Search ..... 281/15 B, 15 R, 42; 402/80 R; 434/430, 431; 40/530, 430

[56] References Cited

U.S. PATENT DOCUMENTS

| | | | |
|---|---|---|---|
| 1,087,336 | 2/1914 | Thurber | 434/430 |
| 1,371,269 | 3/1921 | Stevens | 40/119 |
| 1,487,586 | 3/1924 | MacNicol | 40/119 |
| 1,907,261 | 5/1933 | Shedd | 40/119 |
| 1,931,205 | 10/1933 | Montanye | 40/121 |
| 2,902,295 | 9/1959 | Slaubaugh | 281/15 B |
| 3,645,561 | 2/1972 | Kendall | 24/67.7 |

*Primary Examiner*—Gene Mancene
*Assistant Examiner*—Wenceslao J. Contreras

[57] ABSTRACT

The present invention relates to an easel used to display sheets of paper held to a backing plate by a means for releasably securing the sheets of paper along its upper marginal edge and a means for securing the sheets of paper along its lower marginal edge. An operator advances the display by pulling on the upper marginal edge of the outermost sheet of paper, causing the paper to be released. Gravity pulls the sheet of paper thus released down, exposing the next adjacent sheet of paper. The means for securing the sheets of paper along the lower marginal edge of the backing plate holds the paper in a convenient position of rest while the next sheet of paper is displayed.

3 Claims, 4 Drawing Figures

DISPLAY DEVICE

This is a continuation of application Ser. No. 938,017 filed Aug. 30, 1978, now abandoned.

BACKGROUND OF THE INVENTION

1. Field of the Invention

This invention relates in general to display devices and in particular to an easel for displaying sheets of paper.

2. Description of the Prior Art

An easel or other display device generally uses a fixed backing plate to display paper or similar sheet material. The prior art in this field encompasses devices employing various methods of holding the material in a desired position. A simple method is to position the backing plate at such an angle that the force of gravity prevents the outermost page or sheet from turning, as disclosed in U.S. Pat. Nos. 959,479 and 2,549,306. A related arrangement is disclosed in U.S. Pat. No. 2,877,581, in which the used pages are turned up and held out of sight by the weight of a stiff front cover panel which extends down over the pages. Similarly, U.S. Pat. No. 1,574,245 discloses a calender where the pages of the expired months are supported out of sight not only by the front cover panel, but by a perforation in the page corresponding to a mounting nail which maintains it.

Several types of fastening means other than cover panels are known. For example, U.S. Pat. No. 869,411 discloses the use of a sheet-retaining tongue and U.S. Pat. No. 2,550,386 discloses the use of a slidably mounted plunger. U.S. Pat. No. 1,061,133 discloses a calendar employing a U-shaped clamp to hold up the pages while the music leaf turner disclosed in U.S. Pat. No. 614,372 utilizes several finger-like clamps. U.S. Pat. No. 286,736 discloses a hanging chart wherein the pages are supported by pins which extend through perforated eyes in the page.

SUMMARY OF THE INVENTION

The present invention relates to an improvement in an easel-type display device. When used for displaying a series of sheets of paper, typical easels pose the problem of what to do with the outermost sheet when it is no longer needed. It has been turned up and over the easel to assume a position in back of the backing plate or been completely torn off. Either operation can be unwieldy and difficult to maintain, especially if large-sized paper is used. The present invention solves that problem with a unique easel design.

The easel in the present invention includes a backing plate with a means for releasably securing the paper formed along the upper marginal edge of the backing plate. In the preferred embodiment, a pair of threaded bolts extend through appropriately disposed holes in the sheets of paper and into a cooperating fastener in the backing plate. The bolts hold the pages to the backing plate with a head portion which is slightly larger in diameter than the associated holes in the paper. Along the lower marginal edge of the backing plate, a means for securing the sheets of paper, such as a spring-hinged clip or a second pair of threaded bolts, is used to attach the bottom edge of the sheets of paper to the backing plate. To advance the page, the operator pulls on the upper marginal edge of the outermost sheet, causing it to be released from the head portions of the bolts in the upper marginal edge of the backing plate. Gravity causes the loosened sheet to fall, thus exposing the next adjacent clean sheet of paper. The means for securing the paper along the lower marginal edge of the backing plate holds the paper in a position of rest.

It is, therefore, an object of this invention to produce a display device employing an easel which permits an operator to display a series of illustrations on sheets of paper quickly and easily.

BRIEF DESCRIPTION OF THE DRAWINGS

Other objects and advantages of the invention will be apparent to those skilled in the art from the following detailed description of the invention, when considered in the light of the accompanying drawings, in which.

DETAILED DESCRIPTION OF THE INVENTION

Figure 1:
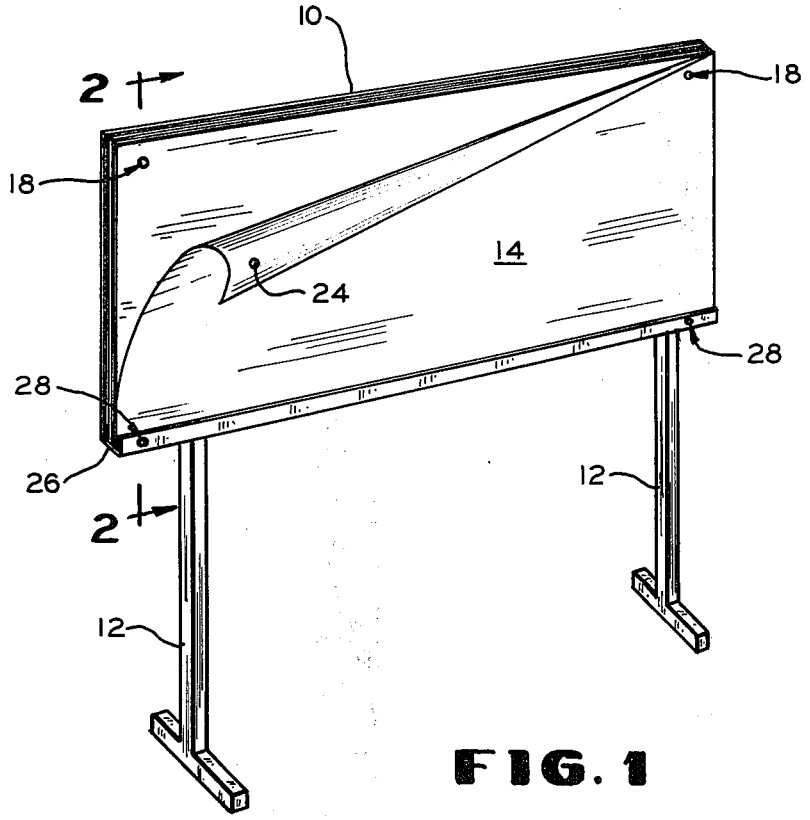
FIG. 1 is a perspective view of an easel incorporating the salient features of the present invention.

Frequently, an easel is used to display a large tablet of sheets of paper upon which an operator may draw or display a series of illustration to an audience. The present invention allows the operator to quickly and easily advance the individual sheets of the tablet with a minimal amount of interference.

Referring to the drawings, there is illustrated an easel-type display device which includes a backing plate 10 suitably supported by a pair of spaced apart depending floor engaging legs 12. The backing plate 10 may be fabricated of any suitable substance, but a rigid lightweight material, such as wood or plastic, exhibits desirable characteristics.

A means for releasably securing a tablet of paper sheets 14 is formed along the upper marginal edge of the backing plate 10. Referring to the embodiment illustrated in FIGS. 1 and 2, the releasably securing means includes one or more inwardly extending threaded shank 16 having an enlarged head portion 18 and a cooperating fastener 20. The fastener 20 can be threaded and formed as an integral part of the backing plate 10 so as to eliminate the need for a separate element. The threaded shank 16 extends through an appropriately disposed hole 24 in the paper 14 and into threaded engagement with the cooperating fastener 20. The head portion 18 of the threaded shank 16 is slightly larger in diameter than the diameter of the hole 24 through which the shank 16 is inserted, thus suitably holding the upper edges of the sheets of paper 14 to the backing plate 10. The head portion 18 should typically not be so large as to cause more than a slight tear in the paper 14 when it is pulled over the head portion 18. To advance the displayed sheets of paper 14, the operator pulls on the upper marginal edge of the outermost sheet of paper 14, causing it to be released from the head portion 18 of the threaded shank 16. Although only two such threaded shanks 16 are illustrated, any feasible number can be utilized. Gravity causes the loosened sheet of paper 14 to fall, thus exposing the next adjacent clean sheet of paper.

A channel member 26 of generally U-shaped cross-section is suitably secured and adapted to extend along the lower marginal edge of the backing plate 10. The channel member 26 may be secured to the backing plate 10 by any conventional method, such as, for example, by rivots, threaded fasteners, or the like (not shown). The channel member 26 is utilized as a means for securing the sheets of paper 14 along the lower marginal edge of the backing plate 10. It has been found to be desirable to provide spaced apart apertures in the outermost leg of the channel member 26 which are adapted to receive adjustable threaded fasteners 28 including a threaded shank portion 30 and a knurled head portion 32. The innermost ends of the threaded shank portions 30 of the fasteners 28 are caused to be moved inwardly by manual adjustment of the head portion 32 to snuggly brace against the lower marginal edge of the paper 14 to maintain the same within the channel member 26.

Figure 3:
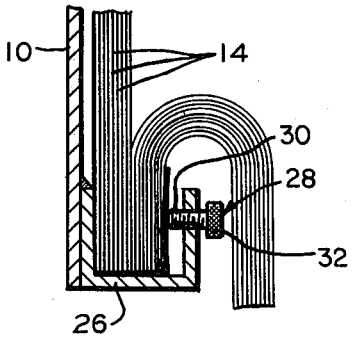
FIG. 3 is a fragmentary sectional view similar to FIG. 2 illustrating the position of the sheets which have been displayed.

It will be appreciated that the channel member 26 may be formed of a variety of materials, but it has been found that excellent results have been achieved by forming the member from an extruded metal stock. Since the paper 14 is snuggly supported in the channel member 26, it will not be removed therefrom when the operator pulls on the upper marginal edge of the paper 14. Instead, the paper 14 falls to a position of rest, as illustrated in FIG. 3. Thereby, the operator can display a series of illustrations quickly and easily, since the paper 14 falls smoothly to a convenient position of rest. While the illustrated embodiment of the invention utilizes a separate backing plate 10 and channel member 26, it must be understood that the same functional results may be achieved by forming the channel 26 as an integral part of the backing plate 10.

Figure 2:
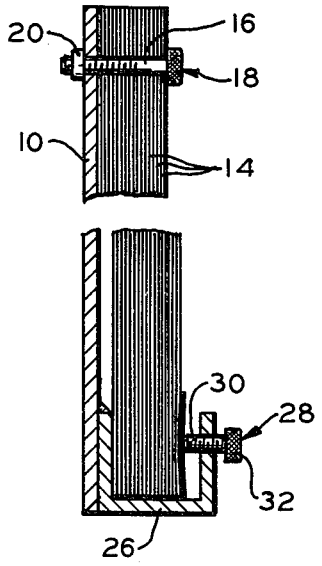
FIG. 2 is an enlarged sectional view of the apparatus illustrated in FIG. 1 taken along line 4—4 thereof.
Figure 4:
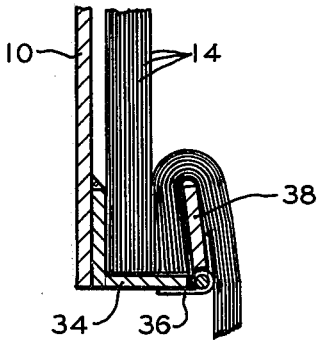
FIG. 4 is a fragmentary sectional view similar to FIG. 3, illustrating an alternate embodiment of the invention.

An alternative embodiment of the invention is illustrated in FIG. 4, wherein the U-shaped channel member 26 of the embodiment illustrated in FIGS. 1, 2, and 3 is replaced by an elongate L-shaped bracket 34 to which a spring-actuated hinge 36 is mounted along the outwardly extending edge thereof. The hinge 36 is effective to pivotally interconnect an elongate extension 38 to the bracket 34. The spring biased extension 38 is, in turn, effective to urge against the lower marginal edge of the paper 14 and securely maintain the same during operation.

It will be seen from the above detailed description of the present invention that a simple display device is provided which eliminates many disadvantages of the above discussed prior art. Various other advantages of the present invention will be apparent to those skilled in the art and various modifications may be made without departing from the scope and spirit of the attached claims.

What I claim is:

1. A free-standing device for supporting a tablet of sheets of paper comprising:

a backing plate including an upper marginal edge and lower marginal edge;

at least one floor engaging leg attached to and supporting said backing plate in a substantially upright position;

means for positioning the upper marginal edge of the tablet of sheets of paper and releasably securing the upper marginal edge of the sheets of paper along the upper marginal edge of said backing plate such that each sheet of paper in the tablet may be individually released;

a channel member, generally U-shaped in cross section, secured to and coextensive with the lower marginal edge of said backing plate adapted to receive and contain the lower marginal edge of a tablet of sheets of paper; and clamping means affixed to one leg of said channel member for snuggly securing the lower marginal edge of the tablet of sheets of paper within said channel member.

2. The invention defined in claim 1 wherein said clamping means comprises at least one fastener threadably received in an opening provided in the outermost leg of said channel member, said threaded fastener having an end engagable with the outermost sheet of paper of the tablet for securing the tablet within said channel member.

3. The invention defined in claim 1 wherein said clamping means comprises hinge means pivotally connecting at least one portion of the outermost leg of said channel member to said channel member and spring means urging said at least one portion of the outermost leg into engagement with the outermost sheet of paper for securing the tablet within said channel member.

* * * * *